US009051811B2

(12) United States Patent
Bussear

(10) Patent No.: US 9,051,811 B2
(45) Date of Patent: Jun. 9, 2015

(54) BARRIER VALVE SYSTEM AND METHOD OF CONTROLLING SAME WITH TUBING PRESSURE

(75) Inventor: Terry R. Bussear, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 384 days.

(21) Appl. No.: 13/434,047

(22) Filed: Mar. 29, 2012

(65) Prior Publication Data

US 2013/0075109 A1 Mar. 28, 2013

Related U.S. Application Data

(63) Continuation-in-part of application No. 12/970,559, filed on Dec. 16, 2010, now Pat. No. 8,550,172, and a continuation-in-part of application No. 13/414,341, filed on Mar. 7, 2012.

(51) Int. Cl.

| | |
|---|---|
| ***E21B 34/14*** | (2006.01) |
| ***E21B 34/10*** | (2006.01) |
| ***E21B 43/12*** | (2006.01) |

(52) U.S. Cl.

CPC ..... *E21B 34/10* (2013.01); *E21B 43/128* (2013.01)

(58) Field of Classification Search

CPC ..... E21B 34/06; E21B 34/10; E21B 34/12; E21B 34/14

USPC ..... 166/375, 242.6, 319, 332.3, 374, 120, 166/122

See application file for complete search history.

(56) References Cited

U.S. PATENT DOCUMENTS

| | | | | |
|---|---|---|---|---|
| 3,493,052 | A | 2/1970 | Evans et al. | |
| 4,274,486 | A | 6/1981 | Fredd | |
| 4,382,623 | A | 5/1983 | Richardson | |
| 4,942,926 | A * | 7/1990 | Lessi | 166/385 |
| 5,058,682 | A * | 10/1991 | Pringle | 166/324 |
| 5,311,939 | A | 5/1994 | Pringle | |
| 5,372,193 | A | 12/1994 | French | |
| 5,465,787 | A | 11/1995 | Roth | |
| 5,831,156 | A | 11/1998 | Mullins | |
| 5,865,251 | A | 2/1999 | Rebardi et al. | |
| 5,875,852 | A | 3/1999 | Floyd et al. | |
| 6,302,216 | B1 | 10/2001 | Patel | |
| 6,352,119 | B1 | 3/2002 | Patel | |

(Continued)

FOREIGN PATENT DOCUMENTS

WO 2011005826 A1 1/2011

OTHER PUBLICATIONS

Martin P. Coronado et al., "Advanced Openhole Completions Utilizing a Simplified Zone Isolation System"; Socity of Petroleum Engineers, SPE Paper No. 77438; Sep. 29, 2002.

(Continued)

*Primary Examiner* — Kenneth L Thompson

(74) *Attorney, Agent, or Firm* — Cantor Colburn LLP

(57) ABSTRACT

A completion system including a barrier valve operatively arranged in a tubing string to selectively impede fluid flow through a lower completion. At least one control line is included for supplying a control line pressure for controlling operation of the barrier valve. The at least one control line is operatively arranged with the tubing string for enabling tubing pressure in the tubing string to determine the control line pressure. A method of operating a barrier valve is also included.

10 Claims, 13 Drawing Sheets

(56) References Cited

U.S. PATENT DOCUMENTS

| | | | | |
|---|---|---|---|---|
| 6,491,102 | B2 | 12/2002 | Leismer et al. | |
| 6,516,886 | B2 | 2/2003 | Patel | |
| 6,598,675 | B2 | 7/2003 | Bussear et al. | |
| 6,675,893 | B2 | 1/2004 | Lund | |
| 6,684,950 | B2 * | 2/2004 | Patel | 166/250.01 |
| 6,695,049 | B2 | 2/2004 | Ostocke et al. | |
| 7,152,688 | B2 | 12/2006 | Richards | |
| 7,219,743 | B2 | 5/2007 | Wolters et al. | |
| 7,228,914 | B2 | 6/2007 | Chavers et al. | |
| 7,322,422 | B2 | 1/2008 | Patel | |
| 7,380,609 | B2 | 6/2008 | Page et al. | |
| 7,428,924 | B2 | 9/2008 | Patel | |
| 7,430,153 | B2 | 9/2008 | Fraser et al. | |
| 7,487,830 | B2 | 2/2009 | Wolters et al. | |
| 7,617,876 | B2 | 11/2009 | Patel et al. | |
| 7,640,977 | B2 | 1/2010 | Jonas | |
| 7,775,275 | B2 | 8/2010 | Patel | |
| 7,896,079 | B2 | 3/2011 | Dyer et al. | |
| 7,950,454 | B2 | 5/2011 | Patel et al. | |
| 8,056,628 | B2 | 11/2011 | Whitsitt et al. | |
| 8,231,947 | B2 | 7/2012 | Vaidya et al. | |
| 8,286,713 | B2 | 10/2012 | Broussard | |
| 2003/0150622 | A1 | 8/2003 | Patel et al. | |
| 2003/0211768 | A1 | 11/2003 | Cameron et al. | |
| 2004/0159444 | A1 | 8/2004 | Wolters et al. | |
| 2005/0092501 | A1 | 5/2005 | Chavers et al. | |
| 2005/0095156 | A1 | 5/2005 | Wolters et al. | |
| 2005/0126789 | A1 | 6/2005 | Nivens et al. | |
| 2005/0230122 | A1 | 10/2005 | Cho et al. | |
| 2006/0151183 | A1 | 7/2006 | Turner | |
| 2007/0084607 | A1 | 4/2007 | Wright et al. | |
| 2007/0119599 | A1 | 5/2007 | Chavers et al. | |
| 2007/0227727 | A1 | 10/2007 | Patel et al. | |
| 2007/0235185 | A1 | 10/2007 | Patel et al. | |
| 2007/0295504 | A1 | 12/2007 | Patel et al. | |
| 2008/0223585 | A1 | 9/2008 | Patel et al. | |
| 2009/0025923 | A1 | 1/2009 | Patel et al. | |
| 2009/0078429 | A1 | 3/2009 | Du et al. | |
| 2009/0218104 | A1 | 9/2009 | Brown | |
| 2010/0206579 | A1 | 8/2010 | Guven et al. | |
| 2010/0236774 | A1 | 9/2010 | Patel et al. | |
| 2010/0270031 | A1 | 10/2010 | Patel | |
| 2010/0300702 | A1 | 12/2010 | Andrews et al. | |
| 2011/0192596 | A1 | 8/2011 | Patel | |
| 2011/0226479 | A1 | 9/2011 | Tippel et al. | |
| 2012/0138309 | A1 | 6/2012 | Lake | |
| 2012/0255738 | A1 | 10/2012 | Lauderdale et al. | |
| 2012/0261137 | A1 | 10/2012 | Martinez et al. | |
| 2013/0075108 | A1 | 3/2013 | Frisby et al. | |
| 2013/0075109 | A1 | 3/2013 | Frisby et al. | |
| 2013/0087344 | A1 | 4/2013 | Reid et al. | |
| 2013/0255946 | A1 | 10/2013 | Frisby et al. | |
| 2013/0255947 | A1 | 10/2013 | Frisby et al. | |
| 2013/0255958 | A1 | 10/2013 | Frisby et al. | |
| 2013/0255961 | A1 | 10/2013 | Frisby et al. | |
| 2013/0306316 | A1 | 11/2013 | Patel | |

OTHER PUBLICATIONS

L Izquierdo et all, "Managing the Retrieval of Triple-Zone Intelligent Completions in Extended-Reach Wells Offshore California"; Society of Petroleum Engineers, SPE Paper No. 112115; Mar. 4, 2008.

Dwayne Leismer, "A System Approach to Annular Control for Total Well Safety"; Offshore Technology Conference; Paper No. OTC 7349; May 3, 1993.

Notification of Transmittal of the International Search Report and the Written Opinion of the International Searching Authority; PCT/US2011/060168; Mailed Jun. 29, 2012; Korean Intellectual Property Office; 10 pages.

Great Britain Search Report for GB Application No. 1303095.2, dated Jun. 24, 2013, pp. 1-5.

K. Munday et al., "Want to Make Tree Operations Safer? Why Not Use the DHSV as a Barrier?"; Society of Petroleum Engineers, SPE Paper No. 96337; Sep. 24, 2006.

T.A. Nassereddin et al., "Electromagnetic Surface-Controlled Sub-Surface Safety Valve: An Immediate Soluation to Secure Wells with Damaged Control Line"; Society of Petroleum Engineers, SPE Paper No. 138356; Nov. 1, 2010.

Notification of Transmittal of the International Search Report and the Written Opinion of the International Searching Authority; PCT/US2011/083519; Mailed Jul. 30, 2012; Korean Intellecutal Property Office; 8 pages.

International Search Report and Written Opinion for PCT Application No. PCT/US2013/026856, dated May 30, 2013, pp. 1-14.

* cited by examiner

BARRIER VALVE SYSTEM AND METHOD OF CONTROLLING SAME WITH TUBING PRESSURE

CROSS REFERENCE

This application is a continuation-in-part of U.S. Non-provisional application Ser. No. 12/970,559 filed on Dec. 16, 2010 and U.S. Non-provisional application Ser. No. 13/414,341 filed on Mar. 7, 2012, which patent applications are incorporated by reference herein in their entireties.

BACKGROUND

In downhole completion systems using Electric Submersible Pumps (ESPs), there is sometimes the need to retrieve the ESP to surface for repair or replacement. The ESP will be a part of an upper completion that will be retrieved as a unit when retrieval of the ESP is required. This will leave a lower completion in the borehole and hence require that a barrier be actuatable to seal off the lower completion. Commonly, a valve is positioned near an uphole extent of the lower completion for this purpose. When replacing the most recently installed completion it is sometimes necessary to use a wet connect arrangement to reconnect to hydraulic control lines of the original barrier valve. While wet connect arrangements are well known and often used in the downhole environment, they are also potentially finicky and hence may not always be favored by operators. The art would therefore well receive alternate systems that increase the ease with which post retrieval valve actuation is achieved.

SUMMARY

A completion system including a barrier valve operatively arranged in a tubing string to selectively impede fluid flow through a lower completion; at least one control line for supplying a control line pressure for controlling operation of the barrier valve, the at least one control line operatively arranged with the tubing string for enabling tubing pressure in the tubing string to determine the control line pressure.

A method of operating a barrier valve, including setting a tubing pressure in a tubing string by pressurizing a fluid; supplying the tubing pressure to at least one control line; setting a control line pressure in the at least one control line with the tubing pressure; and operating a barrier valve with the control line pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
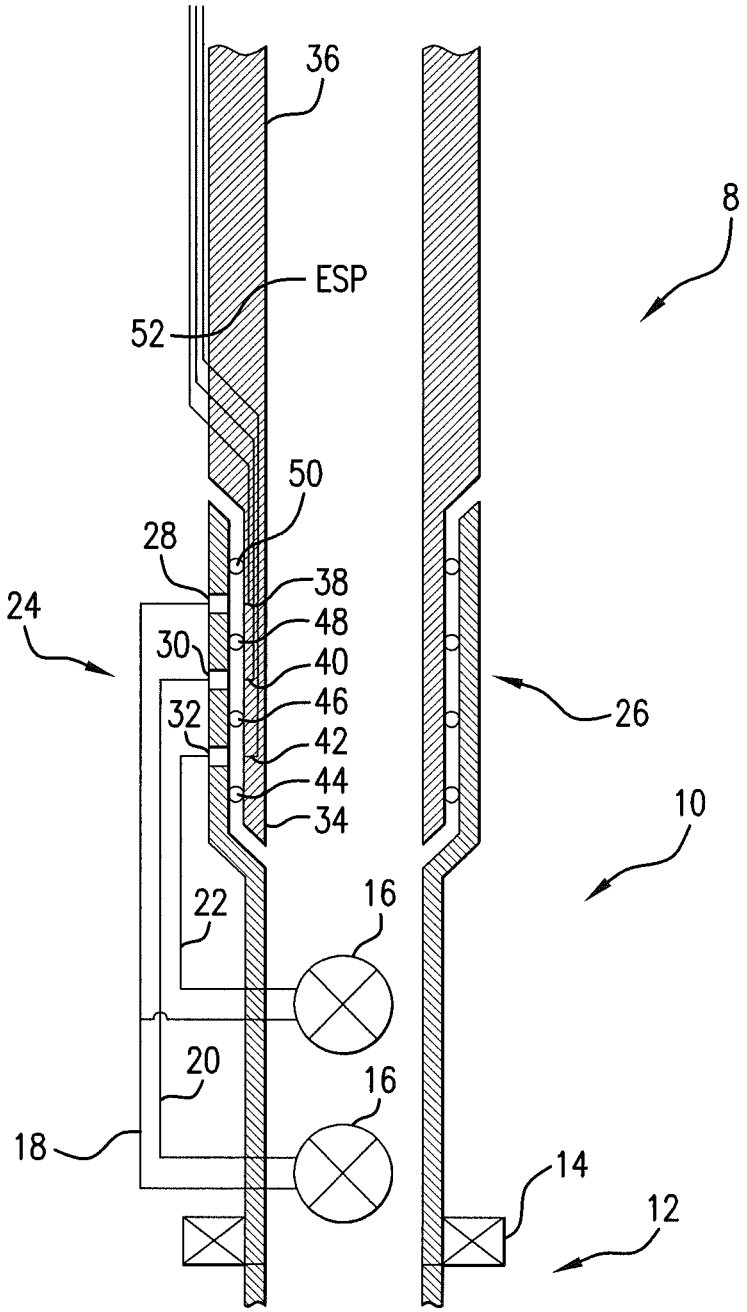
FIG. 1 is a schematic view of a barrier system.

Referring to FIG. 1, an exemplary borehole completion 8 including a barrier valve system 10 is illustrated. The completion 8 includes a lower completion 12 having a packer 14, and part of the barrier valve system 10 having one or more barrier valves 16 (illustrated as two but not limited to two) proximate an uphole extent of the lower completion 12. The barrier valve system 10 itself comprises the one or more barrier valves 16, control lines 18, 20, 22 and an annular connection sub 26, all of which are discussed hereunder. The barrier valves 16 are in operable communication with the control lines 18, 20 and 22 (in this exemplary embodiment, more or fewer are contemplated). The control lines 18, 20 and 22 terminate at a first portion 24 of the annular connection sub 26 having ports 28, 30 and 32 extending radially of the portion 24 of the sub 26. The portion 24 of the sub 26 is interactive with a second portion 34 of the connection sub 26 that is connected to an upper completion 36. The second portion 34 also includes radial ports that are annularly in communication with the ports 28, 30 and 32. The ports of portion 34 are labeled 38, 40 and 42 as three are shown but it is again noted that more or fewer are contemplated and that there are not necessarily the same number of ports on each portion of the connection sub 26. Rather, depending upon where seals are located within the connection sub 26, one or more control lines may be connected to one or more other control lines as desired. The connection sub is more fully described in U.S. Pat. No. 7,487,830, the entire disclosure of which is incorporated herein by reference.

It will be appreciated in FIG. 1 that the connection sub 26 includes a number of seals (illustrated as four in FIG. 1) 44, 46, 48, 50 that separate various port connections from each other. This provides in the illustrated embodiment three control lines extending from the upper completion (likely to surface) to the lower completion. It is to be appreciated that the seals are mounted to the portion 34 so that they are removed from the connection sub 26 upon retrieval of the upper completion 36. This is important to functionality of the system herein described as will be more apparent in the discussion below. As illustrated the three lines are for a common close line that will close all barrier valves of the lower completion upon pressure applied therein and two open lines that will selectively open each of the illustrated barrier valves. The installed system 10 will work appropriately in this configuration.

Upon retrieval of an ESP 52 along with the upper completion 36, the barrier valves 16 will need to be closed to prevent downhole fluids escaping the completion through an open upper extent of the lower completion 12. This will be accomplished by pressuring the common control line 18 for closure of the valves 16. The upper completion 36 may then be withdrawn from the borehole. Upon reintroducing a new upper completion 36 or the original one, the barrier valves 16 must be reopened to reestablish flow potential through the borehole completion system 10. Wet connection as noted above can be problematic and hence the inventor hereof has devised a way to simplify reconnection using a much easier to connect configuration and applied tubing pressure for actuation of the valves 16.

Figure 2:
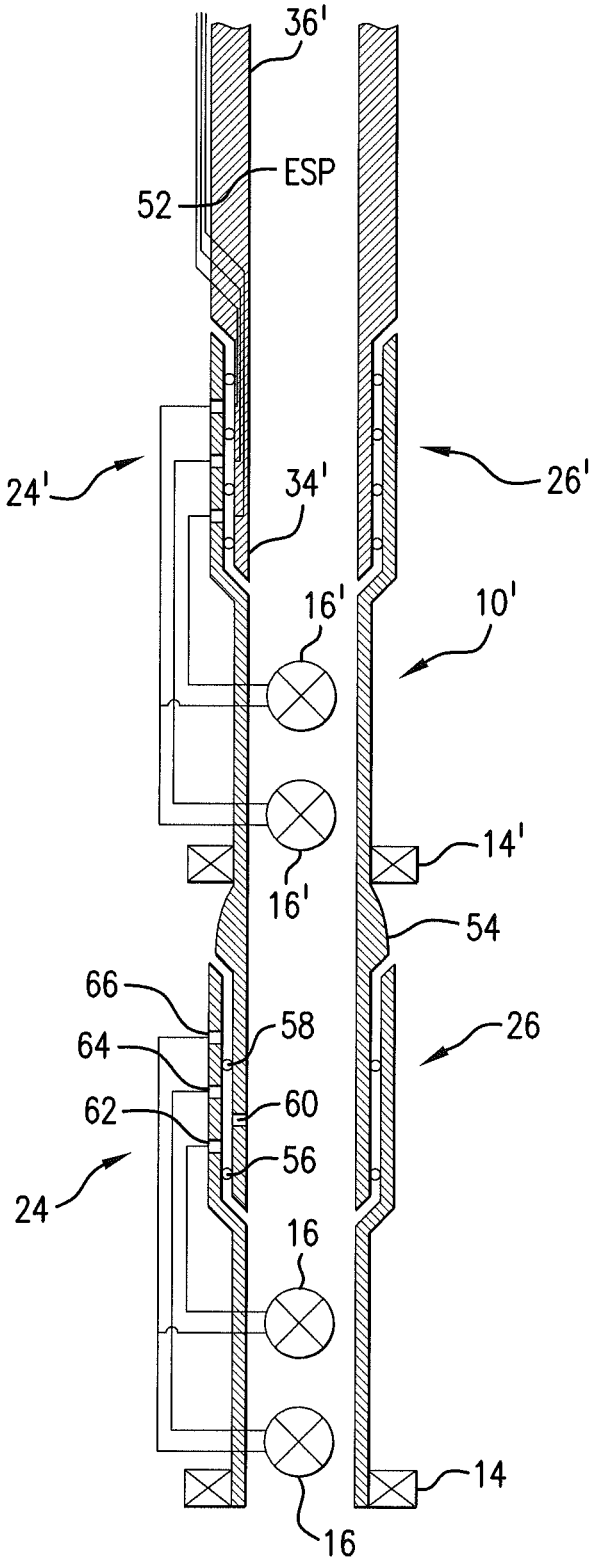
FIG. 2 is a schematic view of a reconnect system operable with the barrier system of FIG. 1.

More specifically, and referring to FIG. 2, a schematic illustration of the reconnect configuration is presented. Reference is made to first portion 24 of connection sub 26 for continuity from the previous discussion. This portion of the connection sub 26 does not change. Moreover, the reader is reminded that the seals were removed with the second portion 34 of the connection sub 26 when the upper completion was retrieved from the borehole leaving the first portion 24 a seal bore. The replacement portion 54 of the connection sub 26 presents seals 56 and 58 in a different position than the seals 44, 46, 48, 50 were in with the original portion 24 of connection sub 26. Rather, seals 56 and 58 are positioned on either side of a port 60 through the replacement portion 54 to an inside diameter thereof such that tubing pressure is ported to a space between seals 56 and 58.

It was noted above that as an exemplary embodiment, the illustrated configuration has two open lines and a common close line. The ports for these lines are in portion 24 and are labeled 62, 64 and 66. The replacement portion 54 does not use the common close line port 66 as can be seen in the drawing, as it is not within the annular space defined by the seals 56 and 58. The ports 62 and 64 are however located between the seals 56 and 58 on replacement portion 54 when the replacement portion is landed in portion 24. This allows the system to provide tubing pressure to the two "open" ports 62 and 64 and through those open the barrier valves 16 that had been closed prior to retrieving the ESP 52 and the upper completion 36. These barrier valves 16 are to remain permanently open at this point. And the original (or previous) portion 24 is not again used to control the now permanently open valves 16.

As can be seen in FIG. 2, the replacement portion 54 is the downhole end of a new barrier valve system 10' having a packer 14', one or more valves 16', a first portion 24' and a portion 34' of a connection sub 26' and control lines equivalent to those described above. This system 10' is affixed to a downhole end of a new or re-run upper completion string 36' and new or repaired ESP 52'. The system provides for a very simple and tolerant wet connect that uses only tubing pressure to actuate previously closed valves 16 to the open position where they will remain pursuant to the addition of one or more new barrier valves 16' to replace the function of the previous ones should the need arise to retrieve the ESP 52' again. Potential pitfalls of conventional wet connect arrangements are avoided through the use of the applied tubing pressure based concept disclosed herein.

In view of the below it will be appreciated that aspects, features, components, arrangements, assemblies, etc. from the systems 10 and 10' are applicable to a variety of other systems, namely, barrier valve systems.

Figure 3:
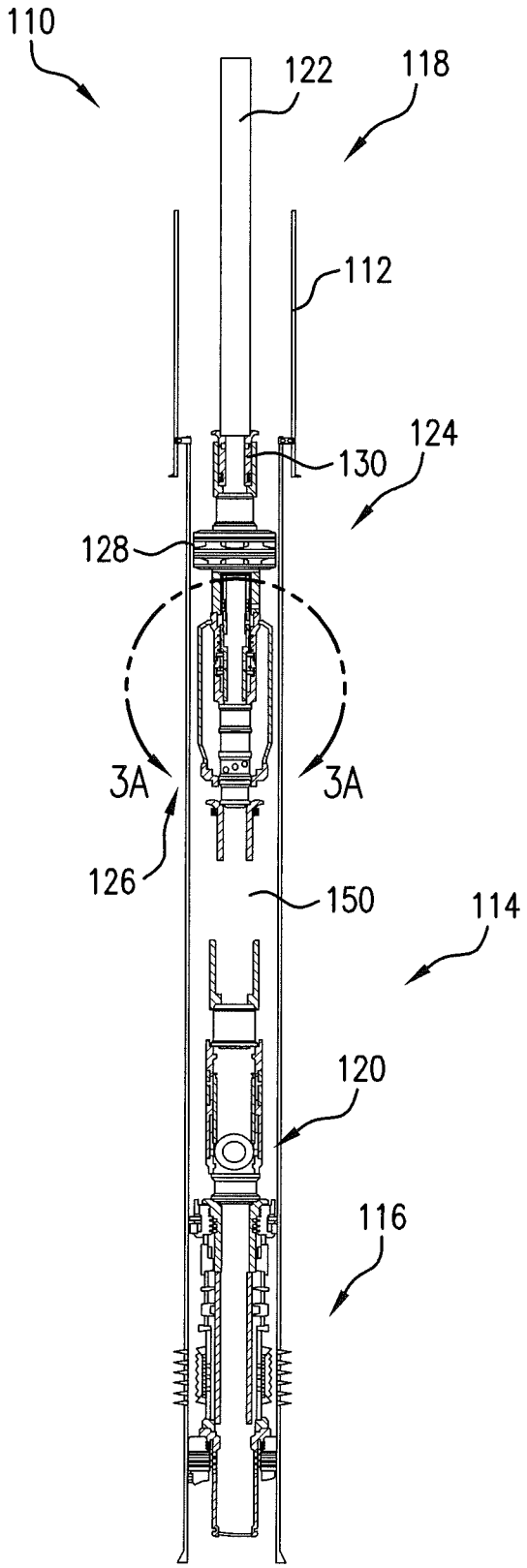
FIG. 3 is a partial cross-sectional view of a completion system in which an intermediate assembly is being engaged with a lower completion.

Referring now to FIG. 3, a completion system 110 is shown installed in a borehole 1&& (cased, lined, open hole, etc.). The system 110 includes a lower completion 114 including a gravel or frac pack assembly 116 (or multiples thereof for multiple producing zones) that is isolated from an upper completion 118 of the system 110 by a fluid loss or fluid isolation valve 120. The gravel or frac pack assembly 116 and the valve 120 generally resemble those known and used in the art. That is, the gravel or frac pack assembly 116 enables the fracturing of various zones while controlling sand or other downhole solids, while the valve 120 takes the form of a ball valve that is transitionable between a closed configuration (shown in FIG. 3) and an open configuration (discussed later) due to cycling the pressure experienced by the valve 120 or other mechanical means, e.g., through an intervention with wireline or tubing. Of course, known types of fluid loss valves other than ball valves could be used in place of the valve 120. Additionally, it is to be appreciated that the lower completion 114 could include components and assemblies other than, or in addition to, the frac pack and/or gravel pack assembly 116, such as for enabling stimulation, hydraulic fracturing, etc.

Figure 3A:
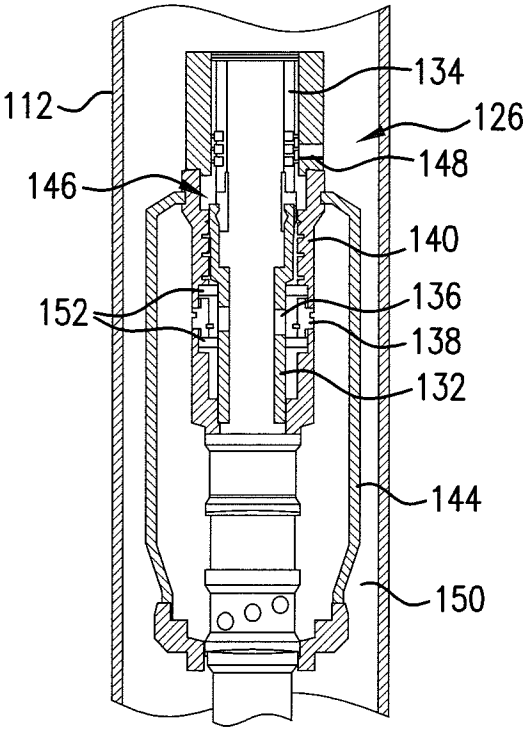
FIG. 3A is an enlarged view of the area circled in FIG. 3.

The system 110 also includes a work string 122 that enables an intermediate completion assembly 124 to be run in. Essentially, the assembly 124 is arranged for functionally replacing the valve 120. That is, while the valve 120 remains physically downhole, the assembly 124 assumes or otherwise takes off at least some functionality of the valve 120, i.e., the assembly 124 provides isolation of the lower completion 114 and the formation and/or portion of the borehole 112 in which the lower completion 114 is positioned. Specifically, in the illustrated embodiment, the assembly 124 in the illustrated embodiment is a fluid loss and isolation assembly and includes a barrier valve 126 and a production packer or packer device 128. By packer device, it is generally meant any assembly arranged to seal an annulus, isolation a formation or portion of a borehole, anchor a string attached thereto, etc. The barrier valve 126 is shown in more detail in FIG. 3A. Initially, as shown in FIGS. 3 and 3A, a shifting tool 130 holds a sleeve 132 of the barrier valve 126 in an open position by an extension 134 of the shifting tool 130 that extends through the packer 128. The term "shifting tool" is used broadly and encompasses seal assemblies and devices that allow relative movement or shifting of the sleeve 132 other than the tool 130 as illustrated. When the sleeve 132 is in its open position, a set of ports 136 in the sleeve 132 are axially aligned with a set of ports 138 in a housing or body 140 of the barrier valve 126, thereby enabling fluid communication through the barrier valve 126. Of course, movement of the sleeve 132 for enabling fluid communication is not limited to axial, although this direction of movement conveniently corresponds with the direction of movement of the work string 122. In the illustrated embodiment, a shroud 144 is radially disposed with the barrier valve 126 for further controlling and/or regulating the flow rate, pressure, etc. of fluid, i.e., by redirecting fluid flow from the lower completion 114 out into the chamber formed by the shroud 144, and back into the barrier valve 126 via the ports 136 and 138 when the valve 126 is open. In the illustrated embodiment, the extension 134 of the shifting tool 130 (and/or the sleeve 132) includes a releasable connection 146 for enabling releasable or selective engagement between the tool 130 and the sleeve 132. For example, the connection 146 could be formed by a collet, spring-loaded or biased fingers or dogs, etc.

Figure 4:
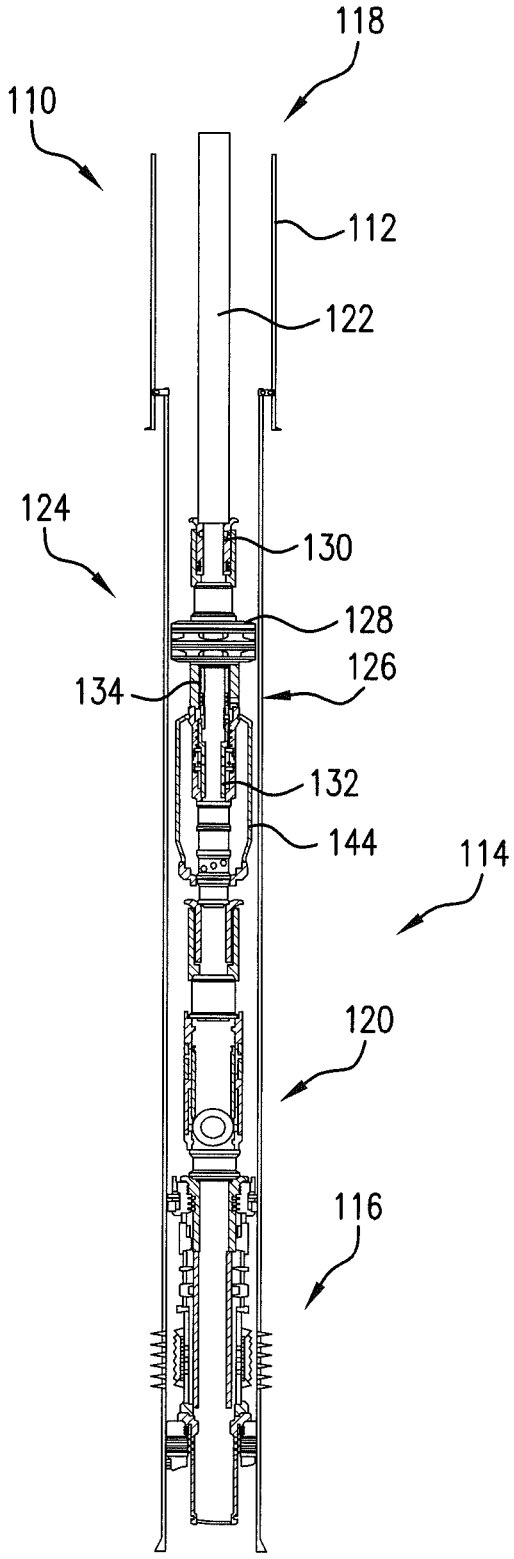
FIG. 4 is a partial cross-sectional view of the completion system of FIG. 1 in which the intermediate assembly is engaged with the lower completion.

A method of assembling and using the completion 110 according to one embodiment is generally described with respect to FIGS. 3-11. As illustrated in FIG. 3, the work string 122 with the assembly 124 is initially run in for connection to the lower completion 114, thereby providing a fluid pathway to surface and enabling production. For example, while circulating fluids in the borehole 112, the assembly 124 can be properly positioned by lowering the work string 122 until circulation stops. After noting the location and slacking off on the work string, the assembly 124 is landed at the lower completion 114, as shown in FIG. 4. Once landed at the lower completion 114, the production packer 128 is set, e.g., via hydraulic pressure in the work string 122, thereby isolating and anchoring the assembly 124. At this point, the barrier valve 126 is open and an equalizing port 148 between the interior of the work string 122 and an annulus 150 is closed by the extension 134 of the shifting tool 130.

Figure 5A:
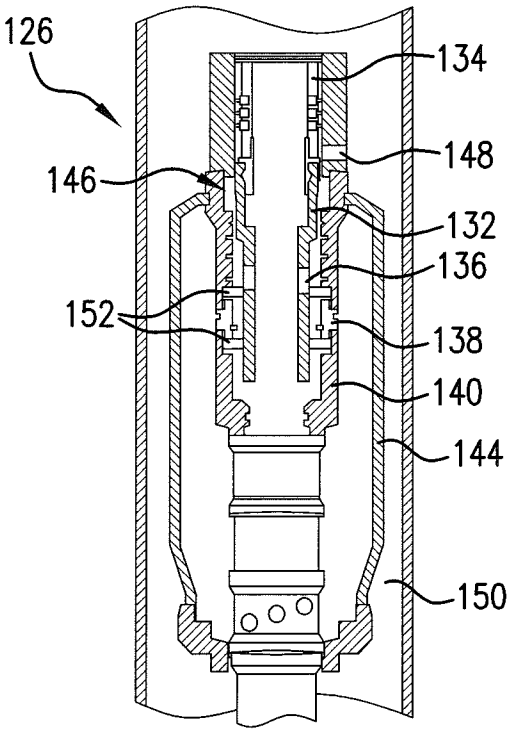
FIG. 5A is an enlarged view of the area circled in FIG. 5.
Figure 5:
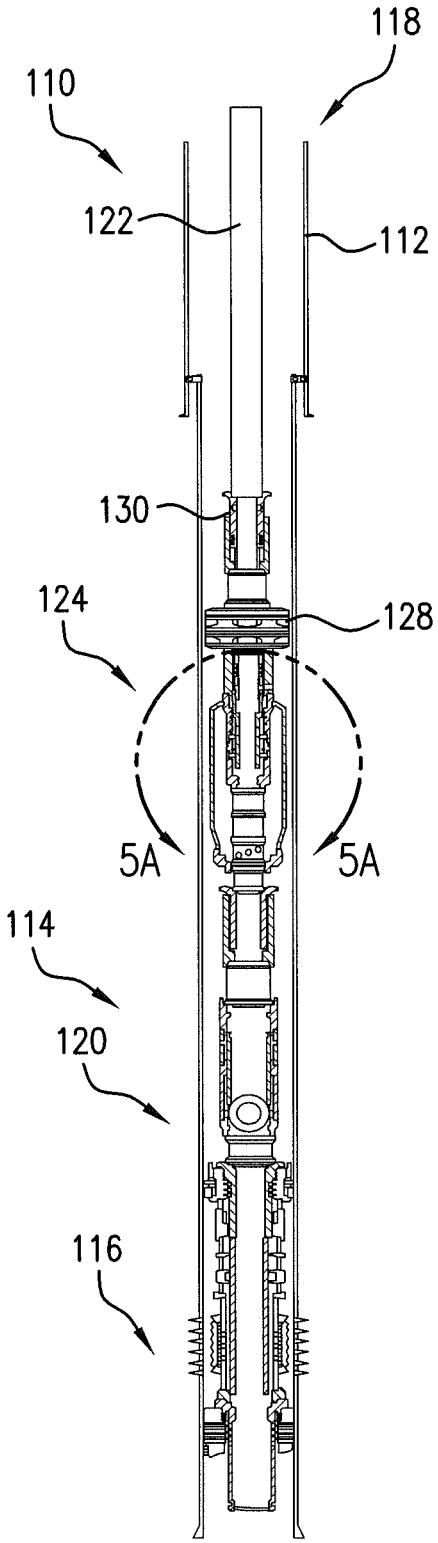
FIG. 5 is a partial cross-sectional view of the completion system of FIG. 1 in which a barrier valve of the intermediate assembly is closed for testing a packer of the intermediate assembly.
Figure 6:
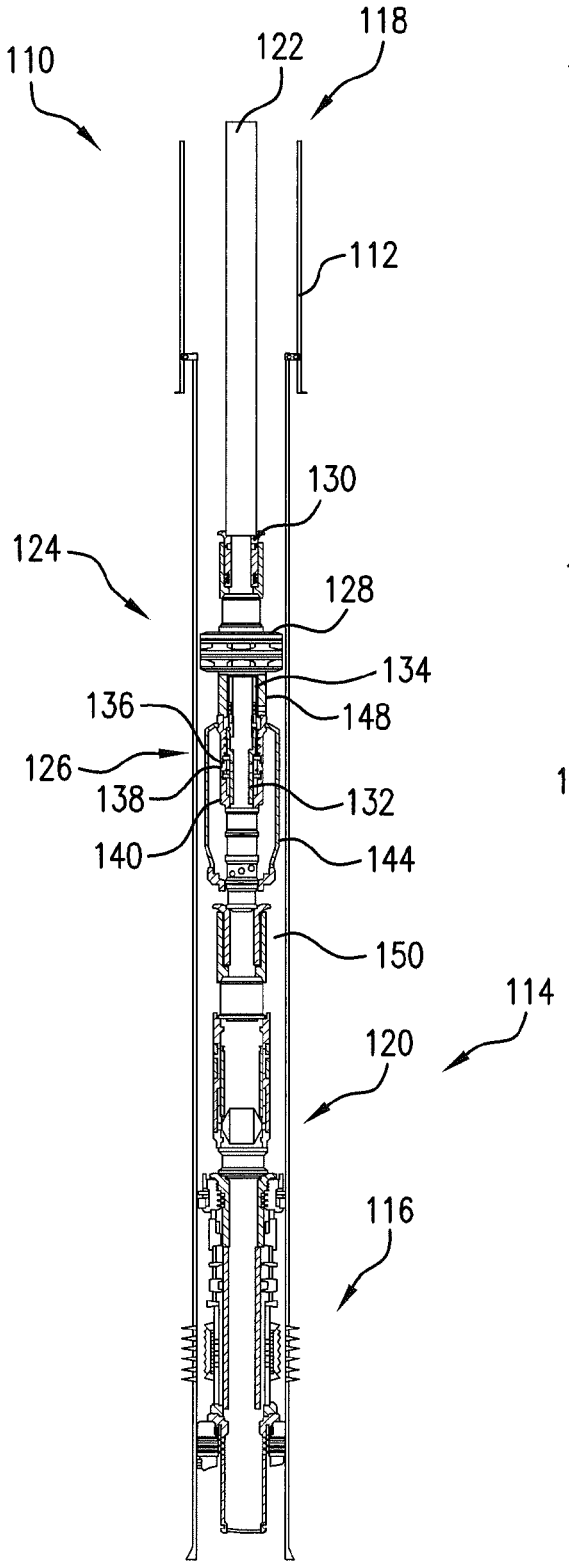
FIG. 6 is a partial cross-sectional view of the completion system of FIG. 1 in which a fluid isolation valve for the lower completion is opened.

As illustrated in FIG. 5, the work string 122 can then be pulled out in order to axially misalign the ports 136 and 138, which closes the barrier valve 126. That is, as shown in more detail in FIG. 5A, communication through the port 138 and into the barrier valve 126 is prevented by a pair of seal elements 152 sealed against the sleeve 132. As also shown in more detail in FIG. 5A, pulling out the work string 122 slightly also opens the equalizing port 148, enabling the packer 128 to be tested on the annulus 150 and/or down the work string 122.

Figure 7:
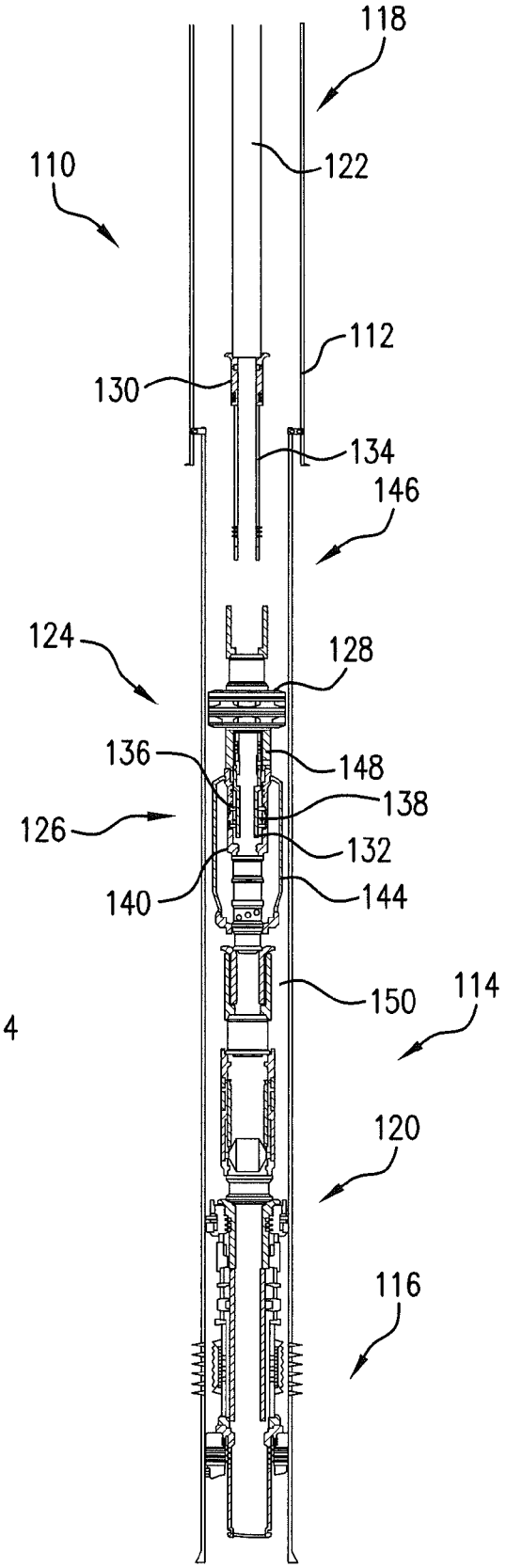
FIG. 7 is a partial cross-sectional view of the completion system of FIG. 1 in which a work string on which the intermediate assembly was run-in is pulled out, thereby closing the barrier valve of the intermediate assembly.

As depicted in FIG. 6, by again slacking off on the work string 122, the barrier valve 126 re-opens (e.g., taking the configuration shown in FIG. 3A) and pressure can be cycled in the work string 122 for opening the fluid loss valve 120. Next, as shown in FIG. 7, the work string 122 is pulled out of the borehole 112. Pulling out the work string 122 first shifts the sleeve 132 into its closed position (e.g., as shown in FIG. 5A) for the barrier valve 126. Then due to the packer 128 anchoring the assembly 114, continuing to pull out the work string 122 disconnects the tool 130 from the sleeve 132 at the releasable connection 146.

Figure 8:
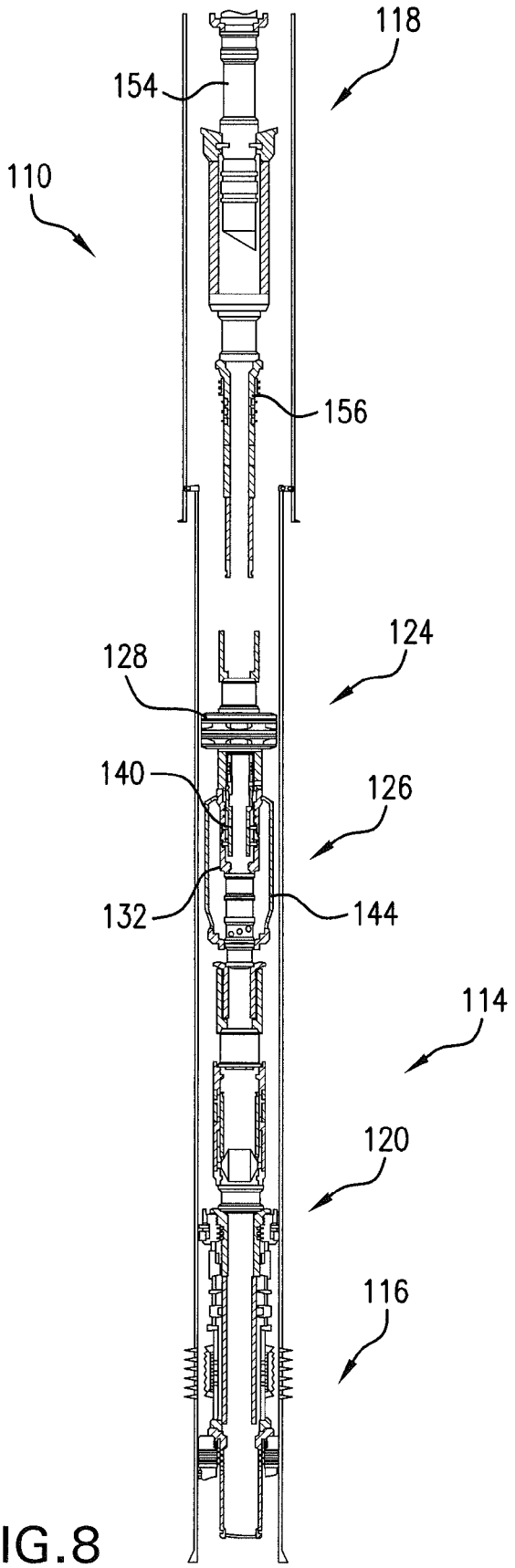
FIG. 8 is a partial cross-sectional view of the completion system of FIG. 1 in which a production string is being run-in for engagement with the intermediate assembly.
Figure 9:
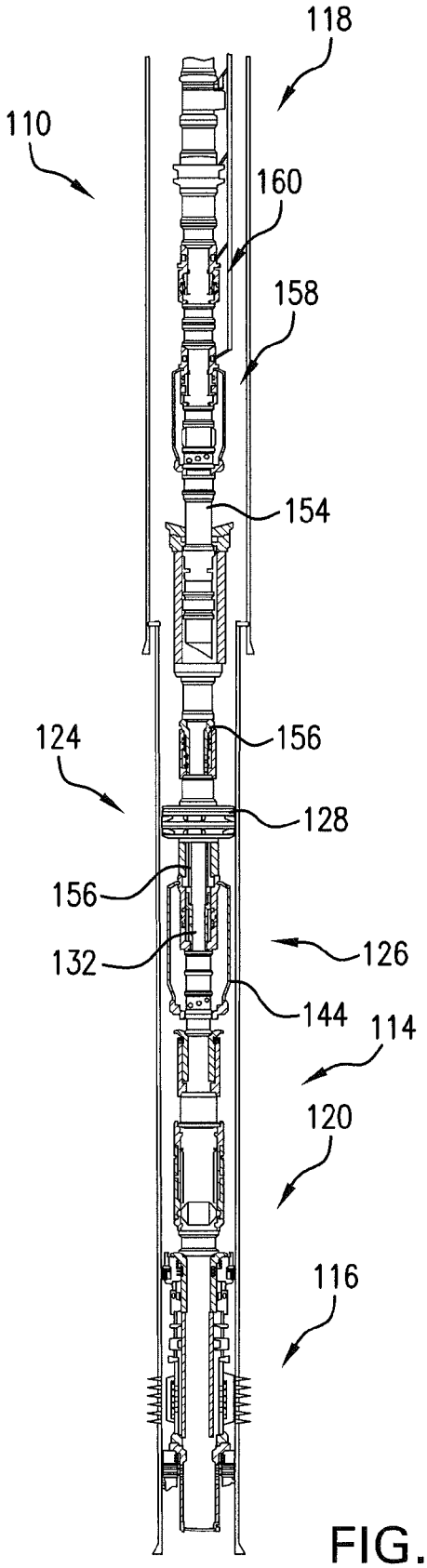
FIG. 9 is a partial cross-sectional view of the completion system of FIG. 1 in which the production string is engaged with the intermediate assembly for opening the barrier valve and enabling production from the lower completion.

In order to start production, a production string 154 is run and engaged with the assembly 124 as shown in FIGS. 8 and 9. The production string 154 includes a shifting tool 156 similar to the tool 130, i.e., arranged with a releasable connection to selectively open and close the barrier valve 126 by manipulating the sleeve 132. In this way, the production string 154 is first landed at the assembly 124 and the tool 130 extended through the packer 128 for shifting the sleeve 132 to open the barrier valve 126. Once the barrier valve 126 is opened, a tubing hanger supporting the production string 154 is landed and fluid from the downhole zones, i.e., proximate to the frac or gravel pack assembly 116, can be produced. In the illustrated embodiment the production string 154 takes the form of an artificial lift system, particularly an ESP system for a deepwater well, which are generally known in the art. However, it is to be appreciated that the current invention as disclosed herein could be used in non-deepwater wells, without artificial lift systems, with other types of artificial lift systems, etc.

Workovers are a necessary part of the lifecycle of many wells. ESP systems, for example, are typically replaced about every 8-10 years, or some other amount of time. Other systems, strings, or components in the upper completion 118 may need to be similarly removed or replaced periodically, e.g., in the event of a fault, damage, corrosion, etc. In order to perform the workover, reverse circulation may be performed by closing a circulation valve 158 and shifting open a hydraulic sliding sleeve 160 of the production string 154. Advantageously, if the production string 154 or other portions in the upper completion 118 (i.e., up-hole of the assembly 124) needs to be removed, removal of that portion will "automatically" revert the barrier valve 126 to its closed position, thereby preventing fluid loss. That is, the same act of pulling out the upper completion string, e.g., the production string 154, the work string 122, etc., will also shift the sleeve 132 into its closed position and isolate the fluids in the lower completion. This eliminates the need for expensive and additional wireline intervention, hydraulic pressure cycling, running and/or manipulating a designated shifting tool, etc. The packer 128 also remains in place to maintain isolation. This avoids the need for expensive and time consuming processes, such as wireline intervention, which may otherwise be necessary to close a fluid loss valve, e.g., the valve 120.

Figure 10:
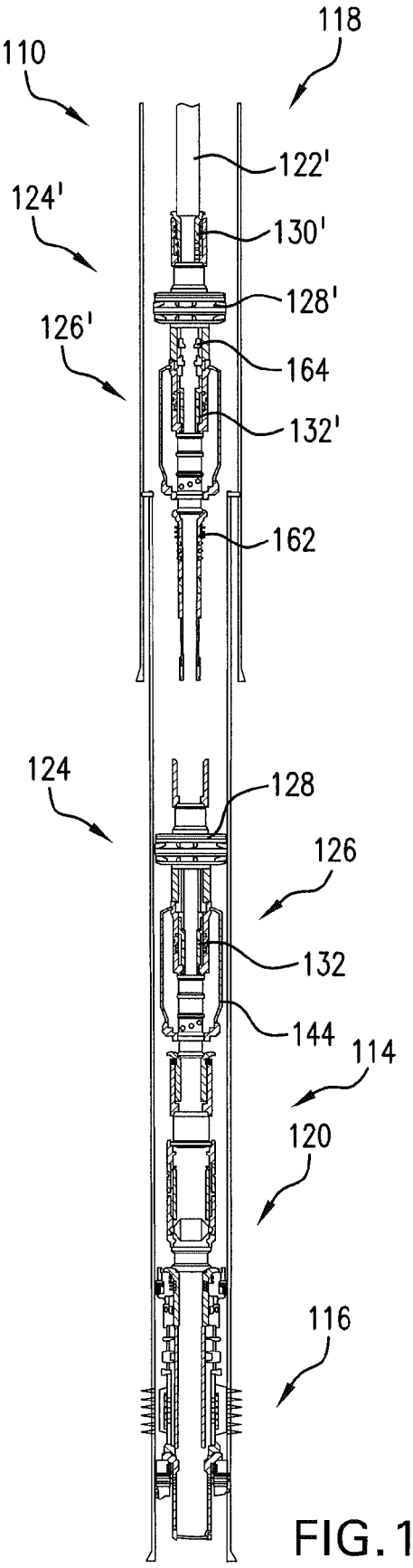
FIG. 10 is a partial cross-sectional view of the completion system of FIG. 1 in which the production string has been pulled out, thereby closing the barrier valve of the intermediate assembly and a subsequent intermediate assembly is being run-in for engagement with the original intermediate assembly.
Figure 11:
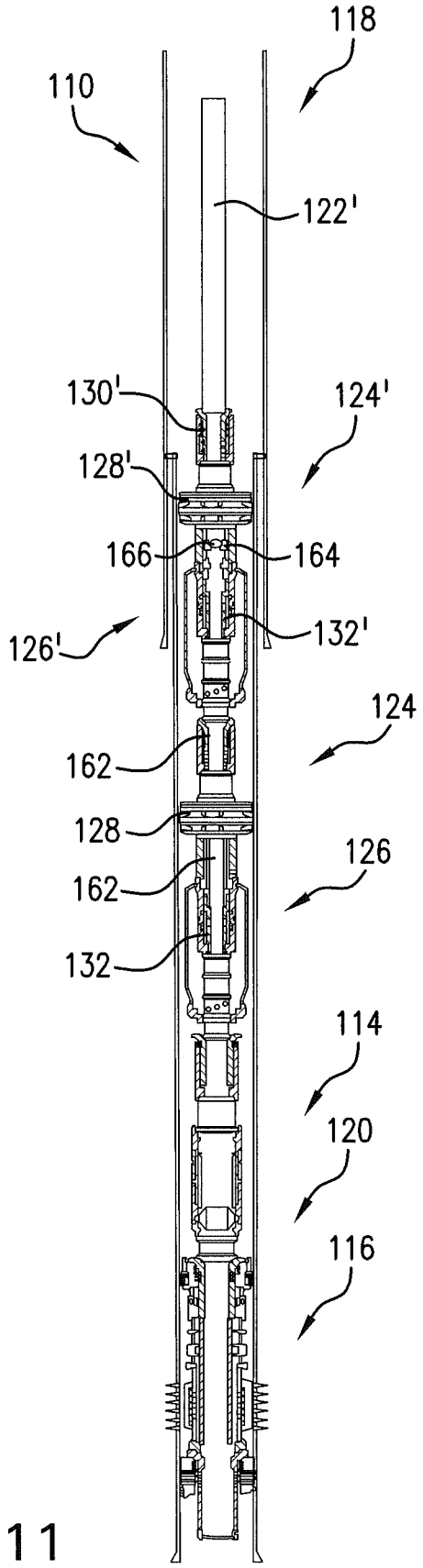
FIG. 11 is a partial cross-sectional view of the completion system of FIG. 1 in which the subsequent intermediate assembly is stacked on the original intermediate assembly.

A replacement string, e.g., a new production string resembling the string 154, can be run back down into the same intermediate completion assembly, e.g., the assembly 124. Alternatively, if a long period of time has elapsed, e.g., 8-10 years as indicated above with respect to ESP systems, it may instead be desirable to run in a new intermediate completion assembly, as equipment wears out over time, particularly in the relatively harsh downhole environment. For example, as shown in FIGS. 10 and 11 an additional or subsequent intermediate completion assembly 124' is run in on a work string 122' for engagement with the original assembly 124. As noted above with respect to the valve 120, the subsequent assembly 124' essentially functionally replaces the original assembly 124. That is, the subsequent assembly 124' substantially resembles the original assembly 124, including a barrier valve 126' for preventing fluid loss, a production packer 128' for reestablishing isolation, and a sleeve 132' that is manipulated by a shifting tool 130' on the work string 122'. It should be appreciated that the aforementioned components associated with the assembly 124' include prime symbols, but otherwise utilize the same base reference numerals as corresponding components described above with respect to the assembly 124, and the above descriptions generally apply to the corresponding components having prime symbols and of the assembly 124' (even if unlabeled), unless otherwise noted.

Unlike the assembly 124, the assembly 124' has a shifting tool 162 for shifting the sleeve 132 of the original assembly 124 in order to open the barrier valve 126, which was closed by the shifting tool 156 when the production string 154 was pulled out. As long as the assembly 124' remains engaged with the assembly 124, the tool 162 will mechanically hold the barrier valve 126 in its open position. In this way, the assembly 124' can be stacked on the assembly 124 and the barrier valve 126' will essentially take over the fluid loss functionality of the barrier valve 126 of the assembly 124 by holding the barrier valve 126 open with the tool 162. It is to be appreciated that any number of these subsequent assemblies 124' could continue to be stacked on each other as needed. For example, a new one of the assemblies 124' could be stacked onto a previous assembly between the acts of pulling out an old upper completion or production string and running in a new one. In this way, the newly run upper completion or production string will interact with the uppermost of the assemblies 124' (as previously described with respect to the assembly 124 and the production string 154), while all the other intermediate assemblies are held open by the shifting tools of the subsequent assemblies (as previously described with respect to the assembly 124 and the shifting tool 162).

The shifting tool 130' also differs from the shifting tool 130 to which it corresponds. Specifically, the shifting tool 130' includes a seat 164 for receiving a ball or plug 166 that is dropped and/or pumped downhole. By blocking flow through the seat 164 with the plug 166, fluid pressure can be built up in the work string 122' suitable for setting and anchoring the production packer 128'. That is, pressure was able to be established for setting the original packer 128 because the fluid loss valve 120 was closed, but with respect to FIGS. 10 and 11 the valve 120 has since been opened and fluid communication established with the lower completion 114 as described previously.

After setting the packer 128', the string 122' can be pulled out, thereby automatically closing the sleeve 132' of the barrier valve 126' as previously described with respect to the assembly 124 and the work string 122 (e.g., by use of a releasable connection). As previously noted, the original barrier valve 126 remains opened by the shifting tool 162 of the subsequent assembly 124'. As the assembly 124' has essentially taken over the functionality of the original assembly 124 (i.e., by holding the barrier valve 126 constantly open with the tool 162), a new production string, e.g., resembling the production string 154, can be run in essentially exactly as previously described with respect to the production string 154 and the assembly 124, but instead engaged with the assembly 124'. That is, instead of manipulating the barrier valve 126, the shifting tool (e.g., resembling the tool 156) of the new production string (e.g., resembling the string 154) will shift the sleeve 132' of the barrier valve 126' open for enabling production of the fluids from the downhole zones or reservoir.

It is again to be appreciated that any number of the assemblies 124' can continue to be run in and stacked atop one another. For example, this stacking of the assemblies 124' can occur between the acts of pulling out an old production string and running a new production string, with the pulling out of each production string "automatically" closing the uppermost one of the assemblies 124' and isolating the fluid in the lower completion 114. In this way, any number of production strings, e.g., ESP systems, can be replaced over time without the need for expensive and time consuming wireline intervention, hydraulic pressure cycling, running and/or manipulation of a designated shifting tool, etc. Additionally, the stackable nature of the assemblies 124, 124', etc., enables the isolation and fluid loss hardware to be refreshed or renewed over time in order to minimize the likelihood of a part failure due to wear, corrosion, aging, etc.

Figure 12:
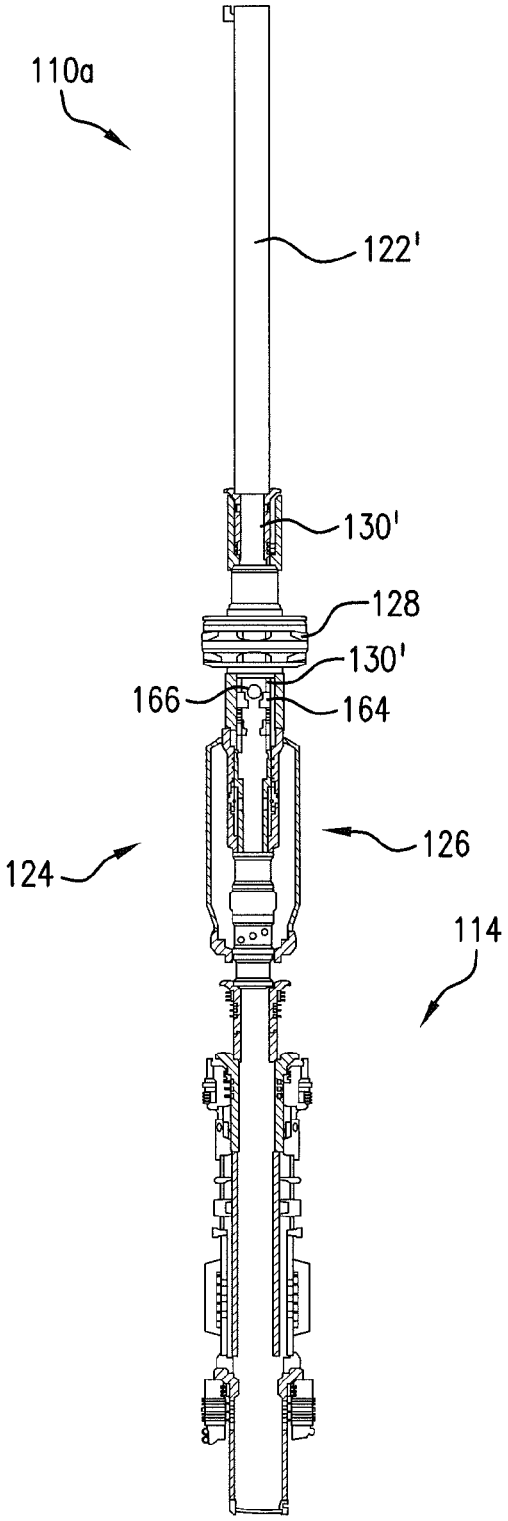
FIG. 12 is a partial cross-sectional view of a completion system according to another embodiment disclosed herein.

It is noted that the fluid loss valve 120 can be substituted, for example, by the assembly 124 being run in on a work string resembling the work string 122' as opposed to the work string 122. For example, as shown in FIG. 12, a modified system 110*a* includes the assembly 124 being run in on the work string 122'. In this way, fluid pressure suitable for setting the original packer 128 can be established by use of the ball seat 164 and the plug 166 instead of the valve 120. Accordingly, as illustrated in FIG. 12, the fluid loss valve 120 is rendered unnecessary or redundant by use of the system 110*a*, as the plug 166 and the seat 164 of the work string 122' enable suitable pressurization for setting the packer 128, and the tool 130' of the work string 122' enables control of the barrier valve 126 such that the assembly 124 can completely isolate the lower completion 114. After isolating the lower completion 114, a production string, e.g., the string 154, subsequent intermediate assemblies, etc., can be run in and interact with the assembly 124 as described above.

Figure 13:
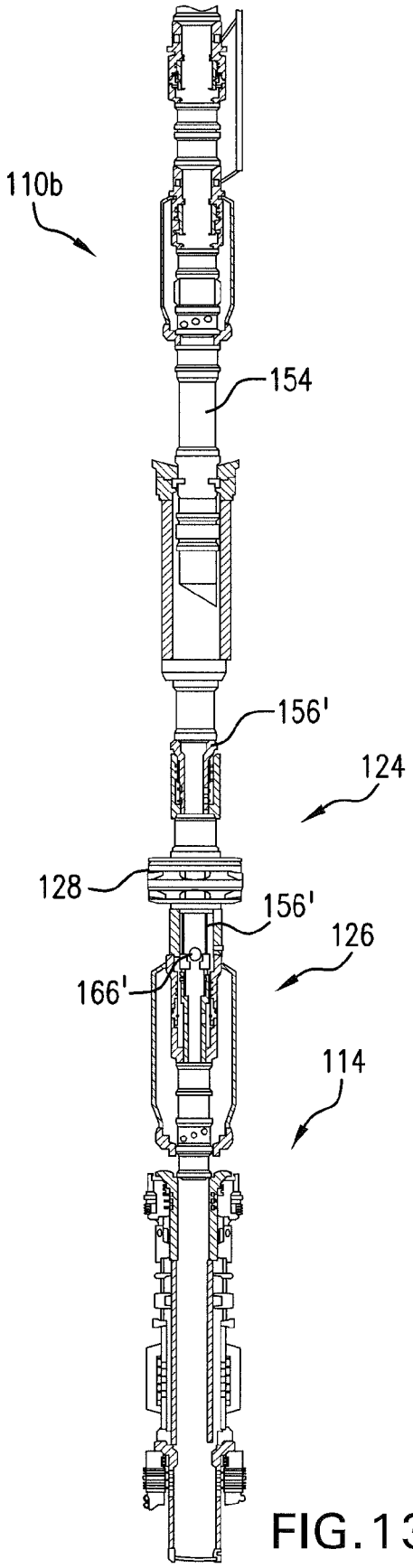
FIG. 13 is a partially cross-sectional view of a completion system according to another embodiment disclosed herein.

As another example, a modified system 110*b* is illustrated in FIG. 13. The system 110*b* is similar to the system 110*a* in that a separate fluid isolation valve for the lower completion 114, e.g., the valve 120, is not necessary and instead the system 110*b* can be run in for initially isolating the lower completion 114. Unlike the system 110*a*, the system 110*b* is capable of being run-in immediately on the production string 154 without the need for the work string 122' of the system 110*a*. Specifically, the system 110*b* is run-in with a plug 166' already located in a shifting tool 156' of the production string 154. The tool 156' resembles the tool 156 with the exception of being arranged to hold the plug 166' therein for blocking fluid flow therethrough. By running the plug 166' in with the system 110*b*, the plug 166' does not need to be dropped and/or pumped from surface, as this would be impossible for various configurations of the production string 154, e.g., if the string 154 includes ESPs or other components or assemblies that would obstruct the pathway of a dropped plug down through the string. The plug 166' is arranged to be degradable, consumable, disintegrable, corrodible, dissolvable, chemically reactable, or otherwise removable so that once it has been used for providing the hydraulic pressure necessary to set the packer 128, the plug 166' can be removed and enable production through the string 154. In one embodiment the plug 166' is made from a dissolvable or reactive material, such as magnesium or aluminum that can be removed in response to a fluid deliverable or available downhole, e.g., acid, brine, etc. In another embodiment, the plug 166' is made from a controlled electrolytic material, such as made commercially available by Baker Hughes, Inc. under the tradename INTALLIC®. Once the plug 166' is removed, the system 110*b* would function as described above with respect to the system 110.

It is thus noted that the current invention as illustrated in FIGS. 3-11 is suitable as a retrofit for systems that are in need of a workover, i.e., need to have the upper completion replaced or removed, but already includes a valve resembling the fluid loss valve 120 (e.g., a ball valve or some other type of valve used in the art that requires wireline intervention, hydraulic pressure cycling, the running and/or manipulation of designated shifting tools, etc., in order to transition between open and closed configurations). Alternatively stated, the system 110 enables downhole isolation of a lower completion for performing a workover, i.e., removal or replacement of an upper completion, without the need for time consuming wireline or other intervention.

In view of the foregoing it is to be appreciated that new completions can be installed with a valve, e.g., the fluid loss valve 120, that requires some separate intervention and/or operation to close the valve during workovers, or, alternatively, according to the systems 110*a* or 110*b*, which not only initially isolate a lower completion, e.g., the lower completion 114, but additionally include a barrier valve, e.g., the barrier valve 126, that automatically closes upon pulling out the upper completion, as described above.

As noted above, certain combinations of the features, aspects, elements, components, and assemblies of the various embodiments described herein are appreciable by one of ordinary skill in the art. In one example, the valves 16 and 16' of the systems 10 and 10' can be replaced by assemblies resembling the intermediate completion assembly 124 and/or 124'. Alternatively stated, the systems 110, 110*a*, and/or 110*b* could include the control lines 18, 20, 22, etc. and other components of the systems 10, 10' for actuating the barrier valves 126 and/or 126' via fluid pressure as opposed to mechanical manipulation. Advantageously, the systems 10, 10' enabling tubing pressure to be converted or otherwise used to set the control line pressure that is used to actuate the valve, e.g., the barrier valve 126 and/or 126' in the current proposed embodiment. In this way, by combining the system 110 with features of the systems 10, 10', the upper completion string, e.g., the upper completion string 154, does not need to be pulled out or otherwise manipulated for controlling the status of the barrier valve 126. Of course, by controlling the barrier valve 126 hydraulically as opposed to mechanically, pulling out the production string 154 may not result in the barrier valve 126 "automatically", so the valve may have to be first closed via fluid pressure, as described with respect to the valves 16, 16' of the systems 10, 10' before the upper completion can be pulled out.

In another embodiment, a barrier valve of a completion system, e.g., the barrier valve 126 of the system 110, could be mechanically shifted by a stroker, sleeve, or other actuatable configuration, where the actuatable configuration is hydraulically controlled. That is, the shifting tools 130, 156, etc. could be equipped with a configuration that is movable, shiftable, and/or actuatable via fluid pressure for operating the sleeve 132 of the barrier valve 126. In this way, a barrier valve, e.g., the barrier valve 126 can be controlled via fluid pressure, while maintaining mechanical actuation of the barrier valve 126, which enables, for example, pulling out the upper completion string to "automatically" close the barrier valve, regardless of the position of the actuation configuration. A representative actuation configuration is described below.

A system 210 is illustrated and described that reduces costs and materials while improving efficiency of the system. Further the system enables a method disclosed hereinbelow to effectively and reliably remove a pump from a downhole environment while adhering to all appropriate best practices and regulatory requirements. The system will be described first to ease understanding of the method.

Figure 14:
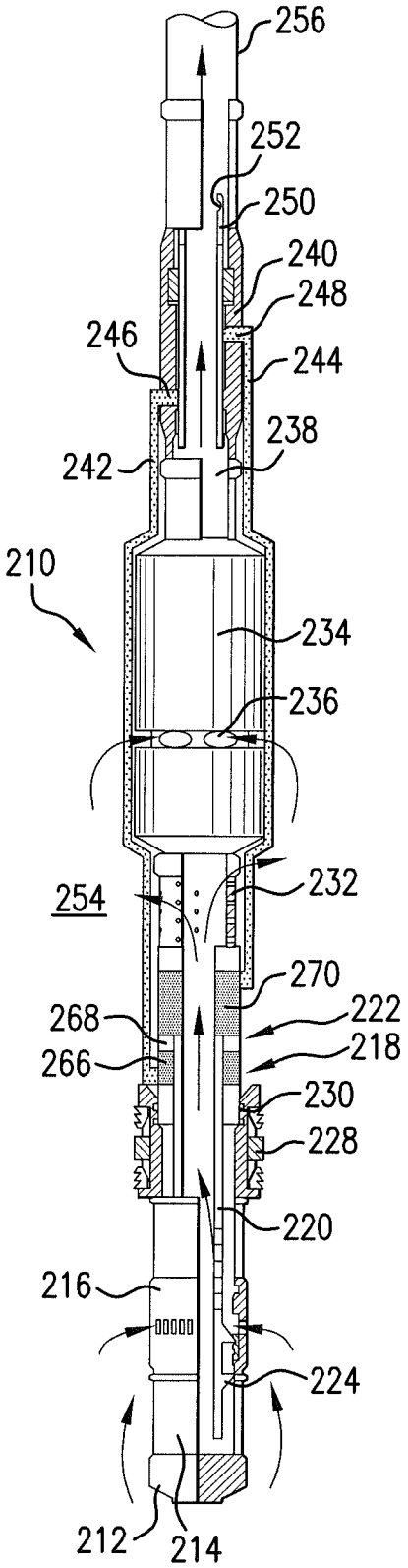
FIG. 14 is a cross sectional schematic view of a system disclosed herein in a first position.

Arbitrarily starting at the downhole end of the system 210 depicted in FIG. 14, a bull plug 212 is mounted at a downhole end of a tail pipe 214 of a valve 216. As illustrated the valve 216 is a sliding sleeve but other valves could be substituted. The valve is actuable with a stroker tool 218 that comprises a shifting sleeve 220 and a hydraulic actuator 222. The shifting sleeve 220 includes an engagement configuration 224 that disengageably engages the sliding sleeve 216 to move the same to an open or a closed position depending upon the direction of actuation from the hydraulic actuator 222. The shifting sleeve 220 further includes openings 226 to allow fluid passage therethrough when the valve 216 is open.

It is well to note that the valve 216 is located downhole of a permanent packer 228 and that the shifting sleeve 220 extends from uphole of the packer 228 to the valve 216 downhole of the packer 228. The hydraulic actuator 222 is landed on the packer 228 at seat 230. When the system is removed from the borehole, the hydraulic actuator is unseated from the packer, leaving the packer and valve in place and the shifting sleeve 220 is pulled up through the center of the packer 228 with the rest of the system as it is being retrieved. The packer and the valve, then, are what contains the formation fluid within the formation when the system is conditioned to close in the well and remove the system.

Adjacent the hydraulic actuator 222 is a perforated sub 232 through which fluids may flow and which spaces the hydraulic actuator 222 from an electronic submersible pump (ESP) 234 (as illustrated) or other pumping arrangement such as a sucker rod, etc. The ESP 234 or other pumping arrangement includes one or more inlets 236 and one or more outlets 238. Adjacent the ESP 234 is a control nipple 240. The nipple 240 presents at least one and as shown two control line connections 246 and 248 for at least one control line and as shown two control lines: a closing control line 242 and an opening control line 244, respectively. The connections extend through the body of the nipple and open to the inside surface at an inside dimension thereof. Without additional structure, the connections labeled as 246 and 248 would both be open to tubing pressure. The control nipple does not however leave the connections open to tubing pressure but rather receives a production/isolation sleeve 250 that blocks both of the control line connections 246 and 248 thereby dead heading the control lines 242 and 244 and hydraulically locking the hydraulic actuator 222. The production/isolation sleeve 250 includes a retrieval feature 252 in order to be retrieved selectively.

In the condition illustrated in FIG. 14 and described above, the system is capable of being on production. The valve 216 is hydraulically locked open by the hydraulic actuator, whose control lines 242 and 244 are dead headed at the production/isolation sleeve. Hydrocarbons or other target fluid is passed from the formation through the open valve 216, through the shifting sleeve 220 and through the inside of actuator 222. The fluid will then move radially outwardly through the holes in perforated sub 232 to the annulus 254. The fluid then enters inlets 236 of the pumping arrangement 234 and is pumped up the tubing string 256.

The configuration as illustrated and described provides for significant benefits to operation of a borehole system as will become more apparent below during discussion of the method of use of the well isolation system described above. The Well isolation system provides further benefits in that the cost of the system is significantly lower than other tools having control line operated hydraulic actuators due to the reduction in length of control lines and the associated reduction in hardware and risks associated with extended length control lines. Finally, the system as described allows the use of tubing pressure to actuate the hydraulic actuator.

The well isolation system described above is particularly suited to facilitate repair or replacement of an ESP (or other arrangement or system) while being in compliance with all regulations and yet still avoid damage to the formation.

Figure 15:
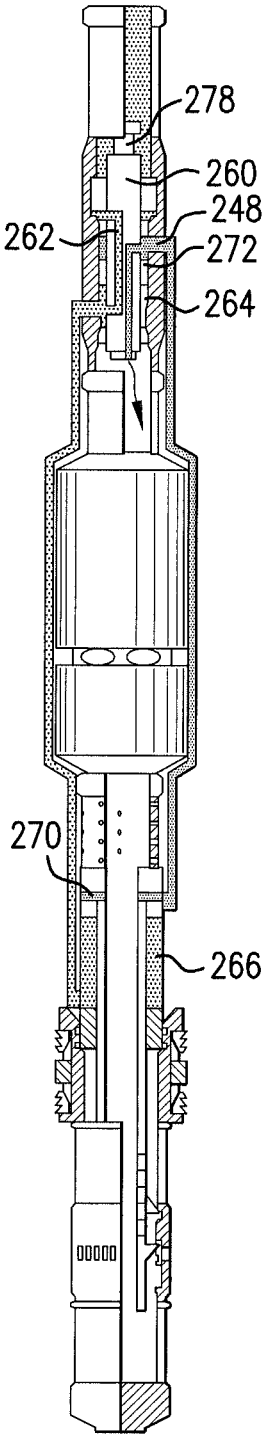
FIG. 15 is a cross sectional schematic view of a system disclosed herein in a second position.

Considering FIGS. 14 and 15 simultaneously, use of the system and the method for controlling the borehole while removing the tubing and pumping arrangement, is addressed. In FIG. 15, it is to be appreciated that the production/isolation sleeve 250 has been removed. The well is being taken off production and is being readied for additional operations related to the replacement of the ESP or other pumping arrangement. Removal of the production/isolation sleeve is done via slickline or similar run from surface and using the retrieval feature 252 to engage and retrieve the production/isolation sleeve. It is to be noted that while slickline is specifically referred to ubiquitously herein, this is exemplary and any other string capable of producing similar results of pulling and running portions of the system 210 is contemplated. Running and retrieving slickline (or other string) is known to the art and need not be shown.

The production and isolation sleeve 250 is replaced with closing plug 260 run into position on another slickline run. The closing plug 260 is an interface member that allows the use of tubing pressure to interact with the relatively short control lines 242 and 244 to effect changes in the position of the stroker 218 and thereby the position of the valve 216.

Closing plug 260 as will be appreciated in FIG. 15 comprises two pathways therein. Closing pathway 262 provides fluid communication between tubing 256 and an annular space 264 created by the closing plug 260, between the closing plug 260 and the nipple 240. Connection 246 is in fluid communication with this annular space 264 and hence tubing pressure is communicated to control line 242. Through this pressure (and fluid) pathway, the actuator 222 can be employed to shift the shifting sleeve 220 simply by pressuring up on the tubing string from surface. With such configuration the benefit of not having a full length control line is realized without any reduction is function of the stroker 218. More specifically, fluid and its accompanying pressure is forced into chamber 266 of hydraulic actuator 222 thereby moving piston 268 in a direction associated with causing the shifting sleeve 220 to close the valve 216. In the configuration shown in FIG. 15, this direction is uphole. The direction could, of course, be reversed if desired or required. FIG. 15 shows chamber 266 much enlarged by inflow of fluid relative to the position shown in FIG. 14 while chamber 270 has become much smaller. The fluid in chamber 270 is forced through control line 244 to closing plug 260. The fluid will pass through connection 248 and annular space 272 created by and between the closing plug 260 and the nipple 240. A dump pathway 274 is presented in closing plug 240 that connects through the annular space 272 to the connection 248 and to the ID outlet of the ESP 234 to dump excess fluid during the closing operation.

At this point the valve 216 is closed and testing to prove this condition can commence. It is desirable to test the condition for at least three reasons. First, closure of valve 216 in conjunction with the packer 228 and bull plug 212 provide a mechanical pressure barrier to facilitate safe removal of the system; second, it is undesirable to lose target produced fluids at the surface due to a leaking valve and third, it is undesirable to allow Kill fluid to enter the formation, where it is likely to deleteriously affect future production. To test the valve, pressure is bled off the well. Tubing 256 pressure is then monitored looking for any increase. If pressure rises, then the formation is still producing through the valve, packer or bull plug meaning that the valve is not fully closed or the listed components are otherwise incapable of holding pressure from the formation. In such case other remediating action may be needed. If pressure does not rise, the valve is indeed closed and it, the bull plug and the packer are holding pressure from below. In some cases, the operator may end testing here but in others there may be an interest in testing from above. This will test packer 228, valve 216 and bull plug 212 as did the test from below but will also test the casing integrity as well. If such is desired, the operator may optionally increase pressure in the column from surface and monitor for bleed down. Assuming at least the first test is successful, meaning that the valve has been successfully closed, the method can be continued.

The closing plug 260 is pulled on slick line, the production/isolation sleeve is run on slickline back to the nipple 240 and then kill weight fluid is added to the well in sufficient volume and density to overbalance formation pressure thereby preventing the production of fluid from the well should the valve 216 fail. The kill fluid is applied though the tubing 256 and makes its way to the inside of the valve 216 where it will stop and apply a pressure that is at least calculated to exert greater pressure on the valve than the formation pressure). Accordingly, the system prevents formation fouling by the kill fluid while still allowing the kill fluid to be used to meet regulations or function as a backup. The well is safe and the Christmas tree can be disconnected, which action will be undertaken at this point and the blow out preventer (BOP) installed. Christmas trees and BOPs are well known in the art and require no explanation.

Figure 16:
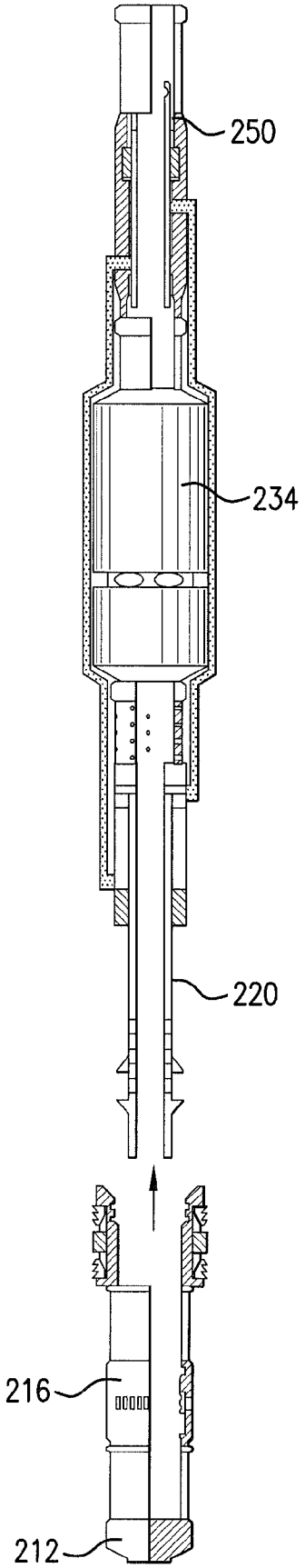
FIG. 16 is a cross sectional schematic view of a system disclosed herein in a third position.
Figure 17:
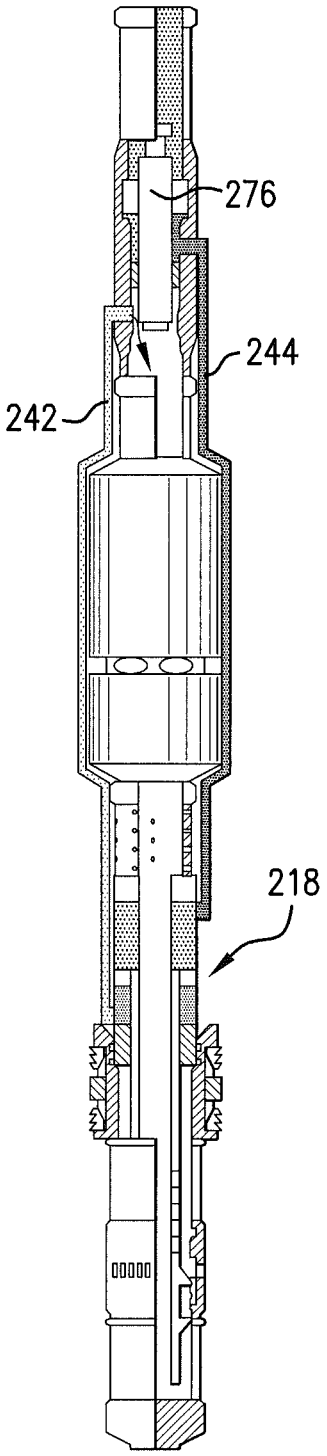
FIG. 17 is a cross sectional schematic view of a system disclosed herein in a fourth position.
Figure 18:
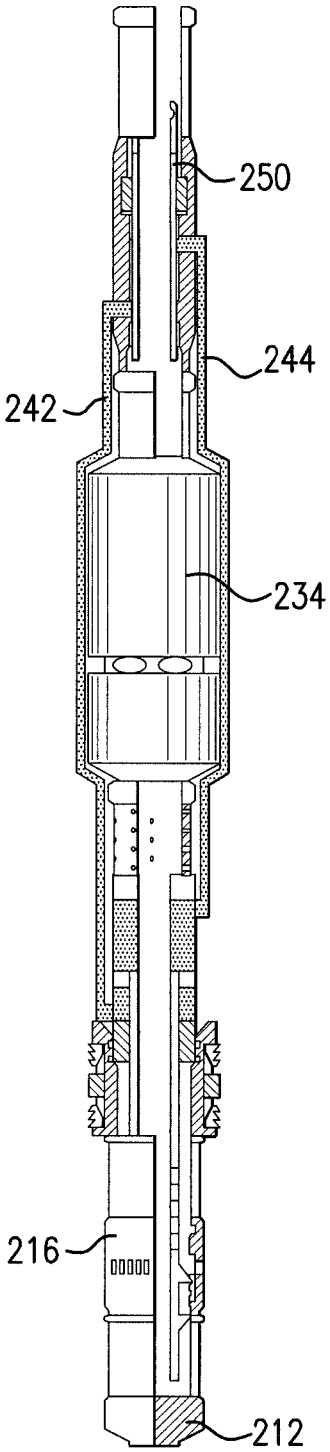
FIG. 18 is a cross sectional schematic view of a system disclosed herein in a fifth position.

The removable portion of the system 210 is now in condition to be pulled to surface as shown in FIG. 16. This includes nipple 240, ESP 234, perforated sub 232, hydraulic actuator 222 and shifting sleeve 220. Whatever is to be done with these components at surface may be done and then the system reset for the trip back into the hole. The system 210, likely with a new ESP 234 is configured with the production/isolation sleeve in place within the nipple 240 and the shifting sleeve 220 at the fully closed position as illustrated. The hydraulic actuator 222 is hydraulically locked with the chamber 266 enlarged and chamber 270 collapsed. The locking is due to the production/isolation sleeve 250 dead-heading the control lines 242 and 244.

The removable portion of the system is now re-run to depth and stabbed back into the packer 228. The valve 216 is still closed and the kill weight fluid is still in place so the BOP can be removed and the Christmas tree reinstalled. A portion of the kill weight fluid is pumped out of the well, that portion ensuring that the remaining kill fluid exerts a pressure on the valve 216 of less than formation pressure so that upon opening of the valve, the kill weight fluid will not penetrate the formation but rather, formation fluid will immediately begin to slowly move through the valve. Subsequently, the production/isolation sleeve 250 is retrieved on slickline through the reinstalled Christmas tree and another slickline run replaces the production/isolation sleeve 250 with an opening plug 276.

The opening plug 276 is similar to the closing plug 260 discussed above but reverses the connection of the control lines 242 and 244 with respect to tubing pressure and dumping duty. The opening plug 276 creates similar annular spaces for fluid communication but communicates tubing fluid/pressure to control line 244 thereby allowing applied tubing pressure from surface to actuate the hydraulic actuator 222 by introducing fluid into chamber 270 and urging the shifting sleeve 220 to move the valve 216 to the open position. Fluid from chamber 266 is routed through control line 242 to a dump pathway in the opening plug and into the outlet of the ESP 234. Once the valve 216 has been fully opened, the opening plug 276 is retrieved again on slick line using the fishing neck 278 and the production/isolation sleeve 250 is re-run into the well. The ESP is tested, fluid level monitored and the well can then be put on production. The remaining kill weight fluid will be produced from the well along with the target fluids.

Again, with respect to the foregoing it will be appreciated how features of the various embodiments can be combined as desired for any number of additional embodiments within the purview of the current disclosure. For example, the shifting tools 130, 156, etc. of the system 110 and/or 110' could be replaced in one embodiment with the fluid pressure controlled stroker tool 218. Alternatively, the valve 216 in the system 210 could be replaced by the intermediate completion assembly 124 and/or 124', such that the sleeve 132 is manipulated by the sleeve 220 of the stroker tool 218. In either embodiment, a barrier valve, e.g., the barrier valve 126, can be controlled via fluid pressure (although indirectly via the stroker tool 218), thereby preventing the need to withdraw or pull out the entire upper completion in order to close the barrier valve, while a mechanical coupling between the sleeve 220 and the sleeve 132 would maintain the ability of the barrier valve 126 to "automatically" close upon withdrawal of the upper completion. Such a modified version of the system could receive opening and closing plugs, e.g., the plugs 260 and 276, as described above with respect to the system 210 in order to control the fluid pressure in the system, and therefore the actuation of the barrier valve.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A completion system comprising:

a barrier valve operatively arranged in a tubing string to selectively impede fluid flow through a lower completion; and at least one control line extending between the tubing string and a stroker tool including a hydraulic actuator and a shifting sleeve, the stroker tool mechanically shifting the barrier valve in response to the control line pressure, the at least one control line operatively arranged with the tubing string for enabling tubing pressure in the tubing string to determine the control line pressure the system further including a plug interactive with a nipple to deliver tubing pressure to the at least one control line.

2. The completion system of claim 1, wherein the barrier valve comprises a sliding sleeve.

3. The completion system of claim 1, wherein the barrier valve is part of an intermediate completion assembly that also includes a packer device for both isolating the lower completion and a borehole in which the lower completion is positioned.

4. A completion system comprising:

a barrier valve operatively arranged in a tubing string to selectively impede fluid flow through a lower completion; and at least two control lines extending between the tubing string and a stroker tool including a hydraulic actuator and a shifting sleeve, the stroker tool mechanically shifting the barrier valve in response to the control line pressure, the at least two control lines operatively arranged with the tubing string for enabling tubing pressure in the tubing string to determine the control line pressure and each of which are conditionable to respond to tubing pressure to stroke the stroker in a direction or an opposite direction.

5. A completion system comprising:

a barrier valve operatively arranged in a tubing string to selectively impede fluid flow through a lower completion; and at least one control line extending between the tubing string and a stroker tool including a hydraulic actuator and a shifting sleeve, the stroker tool mechanically shifting the barrier valve in response to the control line pressure, the at least one control line operatively arranged with the tubing string for enabling tubing pressure in the tubing string to determine the control line pressure and wherein the system further includes a plug having a pathway defined therein that leads to tubing pressure at one end and to the at least one control line at the other end.

6. A completion system comprising:

a barrier valve operatively arranged in a tubing string to selectively impede fluid flow through a lower completion; and at least one control line extending between the tubing string and a stroker tool including a hydraulic actuator and a shifting sleeve, the stroker tool mechanically shifting the barrier valve in response to the control line pressure, the at least one control line operatively arranged with the tubing string for enabling tubing pressure in the tubing string to determine the control line pressure, the system further comprising an upper completion operatively coupled with the barrier valve for closing the barrier valve when the upper completion is withdrawn.

7. A method of operating a barrier valve, comprising:

setting a tubing pressure in a tubing string by pressurizing a fluid;

supplying the tubing pressure to at least one control line;

setting a control line pressure in the at least one control line with the tubing pressure; and operating a barrier valve with the control line pressure through a stroker tool that mechanically shifts the barrier valve, the barrier valve positioned as part of an intermediate completion assembly run in on a production string pressurizing up on an isolation sleeve run in with the production string for setting a packer device of the intermediate completion assembly, the method further comprising stacking at least one subsequent intermediate assembly with the intermediate completion assembly, the subsequent intermediate assembly having a subsequent barrier valve operatable by the control line pressure for functionally replacing the barrier valve.

8. The method of claim 7, wherein the barrier valve is part of a lower completion.

9. A method of operating a barrier valve, comprising:

setting a tubing pressure in a tubing string by pressurizing a fluid;

supplying the tubing pressure to at least one control line;

setting a control line pressure in the at least one control line with the tubing pressure; and operating a barrier valve with the control line pressure through a stroker tool that mechanically shifts the barrier valve, the barrier valve positioned as part of an intermediate completion assembly run in on a production string pressurizing up on an isolation sleeve run in with the production string for setting a packer device of the intermediate completion assembly, the method further comprising running a plug having a pathway defined therein that leads to tubing pressure at one end and to one of the at least one control line operatively arranged to close the barrier valve at an opposite end.

10. A method of operating a barrier valve, comprising:

setting a tubing pressure in a tubing string by pressurizing a fluid;

supplying the tubing pressure to at least one control line;

setting a control line pressure in the at least one control line with the tubing pressure; and operating a barrier valve with the control line pressure through a stroker tool that mechanically shifts the barrier valve, the barrier valve positioned as part of an intermediate completion assembly run in on a production string pressurizing up on an isolation sleeve run in with the production string for setting a packer device of the intermediate completion assembly, the method further comprising replacing the isolation sleeve with a plug, pressuring up on the tubing pressure, and directing the tubing pressure to one of the at least one control lines operatively arranged to open the barrier valve with the control line pressure.

* * * * *